US005120144A

United States Patent [19]

Lund

[11] Patent Number: 5,120,144

[45] Date of Patent: * Jun. 9, 1992

[54] PAPER SEPARATOR

[75] Inventor: William J. Lund, Stockton, Calif.

[73] Assignee: Lund Company, Ltd., Stockton, Calif.

[ * ] Notice: The portion of the term of this patent subsequent to Jul. 10, 2007 has been disclaimed.

[21] Appl. No.: 516,551

[22] Filed: Apr. 30, 1990

Related U.S. Application Data

[63] Continuation-in-part of Ser. No. 156,207, Feb. 16, 1988, Pat. No. 4,940,347, and a continuation-in-part of PCT/US89/00585, Feb. 16, 1988.

[51] Int. Cl.[5] ..... B41J 11/68

[52] U.S. Cl. ..... 400/621.1; 225/100; 225/3

[58] Field of Search ..... 400/621, 621.1, 621.2; 225/3, 6, 93, 98, 99, 100

[56] References Cited

U.S. PATENT DOCUMENTS

| | | | |
|---|---|---|---|
| 2,171,769 | 9/1939 | Stolar et al. | 164/84.5 |
| 2,188,347 | 1/1940 | Fulk | 400/621.1 |
| 2,208,994 | 7/1940 | Mabon | 225/3 |
| 2,308,551 | 1/1948 | Sherman | 164/38 |
| 2,317,384 | 4/1948 | Johnson | 164/84.5 |
| 2,717,642 | 9/1955 | Pealler | 225/100 |
| 3,825,162 | 7/1974 | Hubbard | 226/74 |
| 4,096,981 | 6/1978 | Martorano | 225/99 |
| 4,129,239 | 12/1978 | Hubbard | 226/75 |
| 4,423,975 | 1/1984 | Krenz | 400/616 |
| 4,616,773 | 10/1986 | Kerivan | 225/99 |

FOREIGN PATENT DOCUMENTS

| | | | |
|---|---|---|---|
| 241251 | 10/1962 | Australia . | |
| 3119998 | 12/1982 | Fed. Rep. of Germany | 400/621.1 |
| 2599298 | 12/1987 | France | 400/621.1 |
| 0297163 | 12/1986 | Japan | 400/621.1 |

*Primary Examiner*—Edgar S. Burr
*Assistant Examiner*—John S. Hilten
*Attorney, Agent, or Firm*—Walter A. Hackler

[57] ABSTRACT

A paper transfer feed separator automatically separates paper-drive edge tear strips from paper forms along perforations. The paper transfer feed separator may be hand-held and motor driven for removing the paper drive edge tear strips after the paper form is removed from a printer, or the like, or incorporated into a printer so that separation of the edge strips occurs simultaneously with printing on the paper. The frame of the separator causes a divergence in the paths of the body of the form and the edge paper strip to cause separation thereby, eliminating the need for knife blades or other elements requiring maintenance.

16 Claims, 6 Drawing Sheets

FIG. 7.
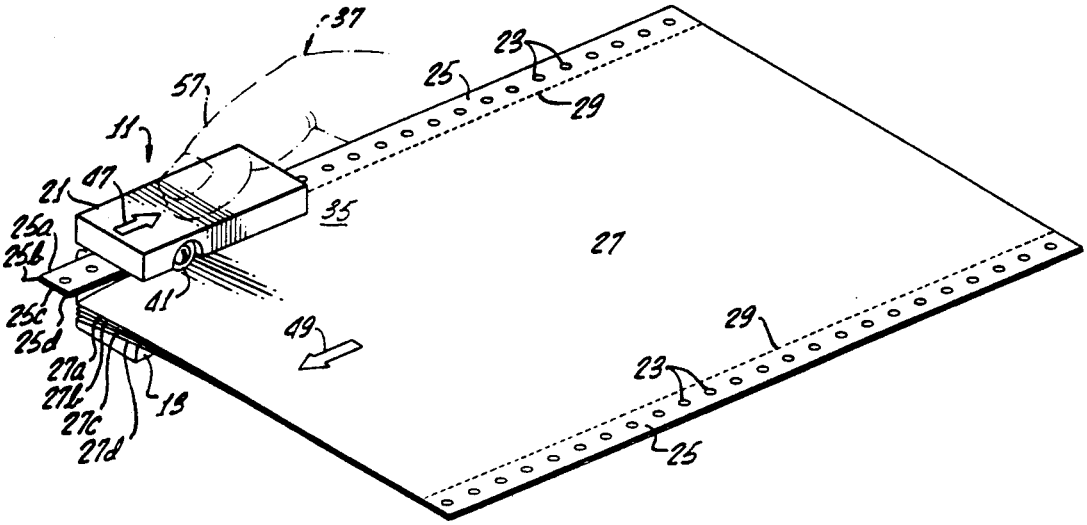
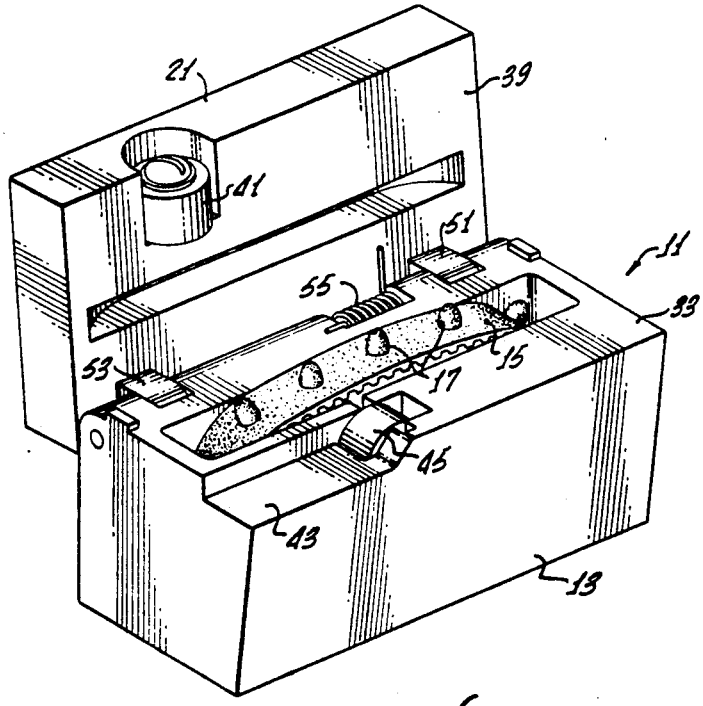
FIG. 8.

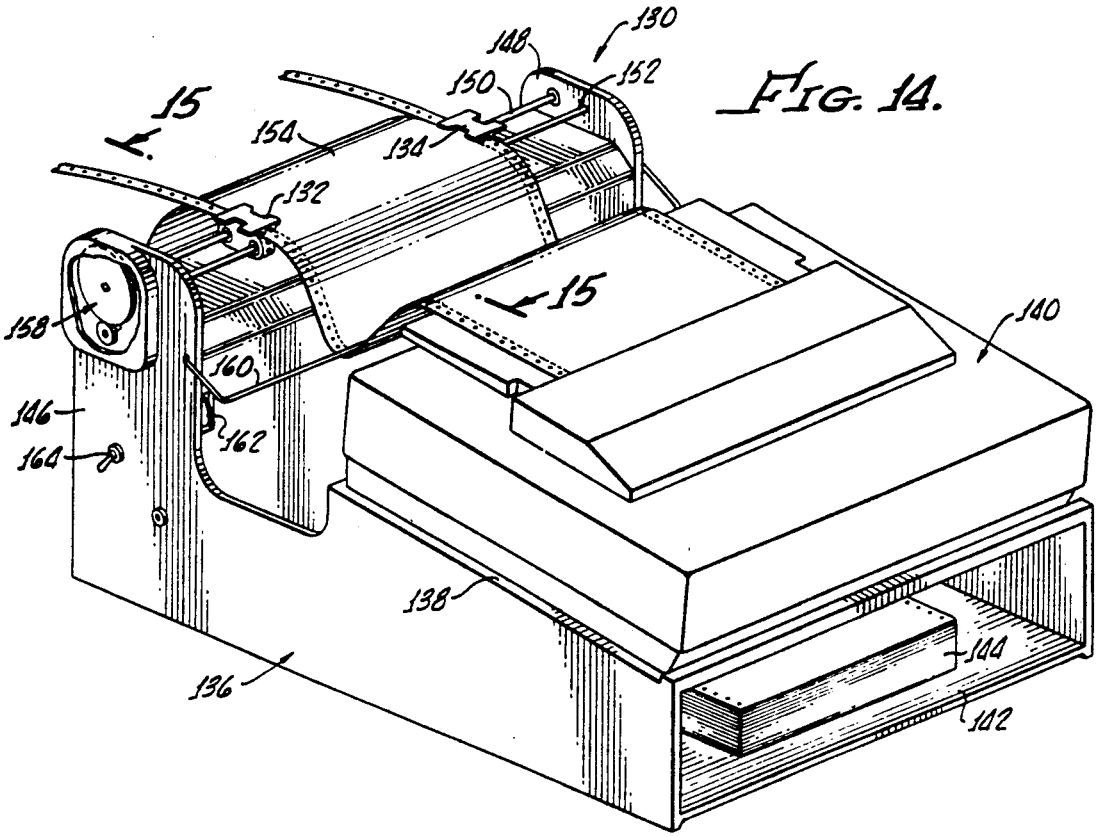
FIG. 14.
FIG. 15.
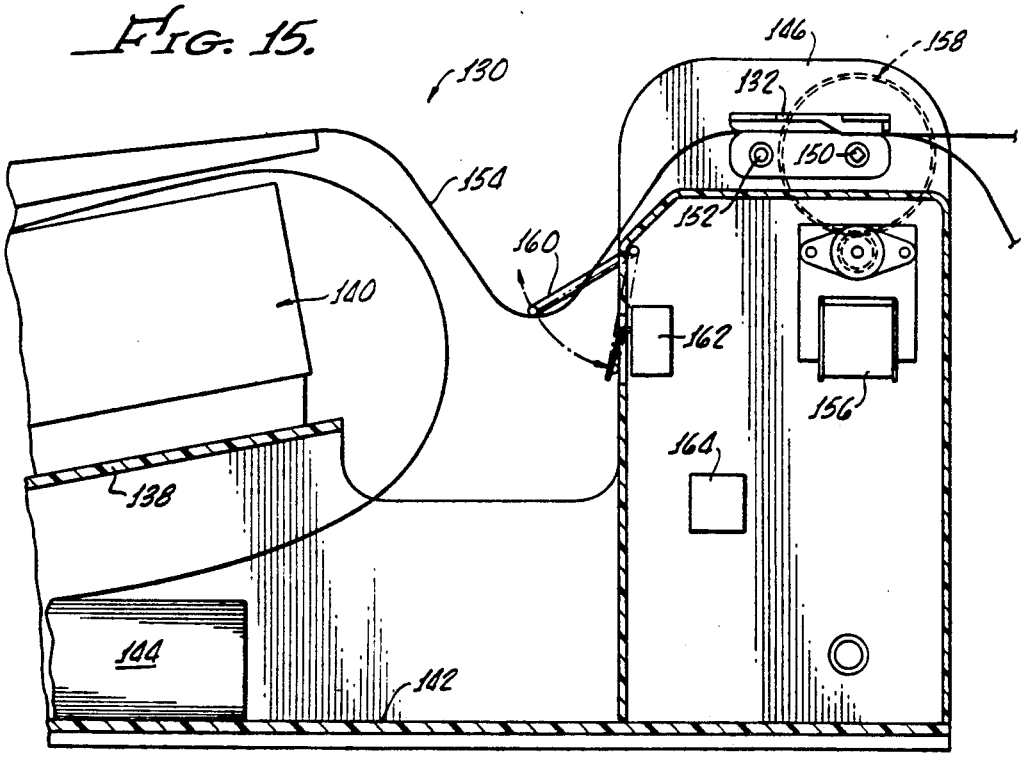

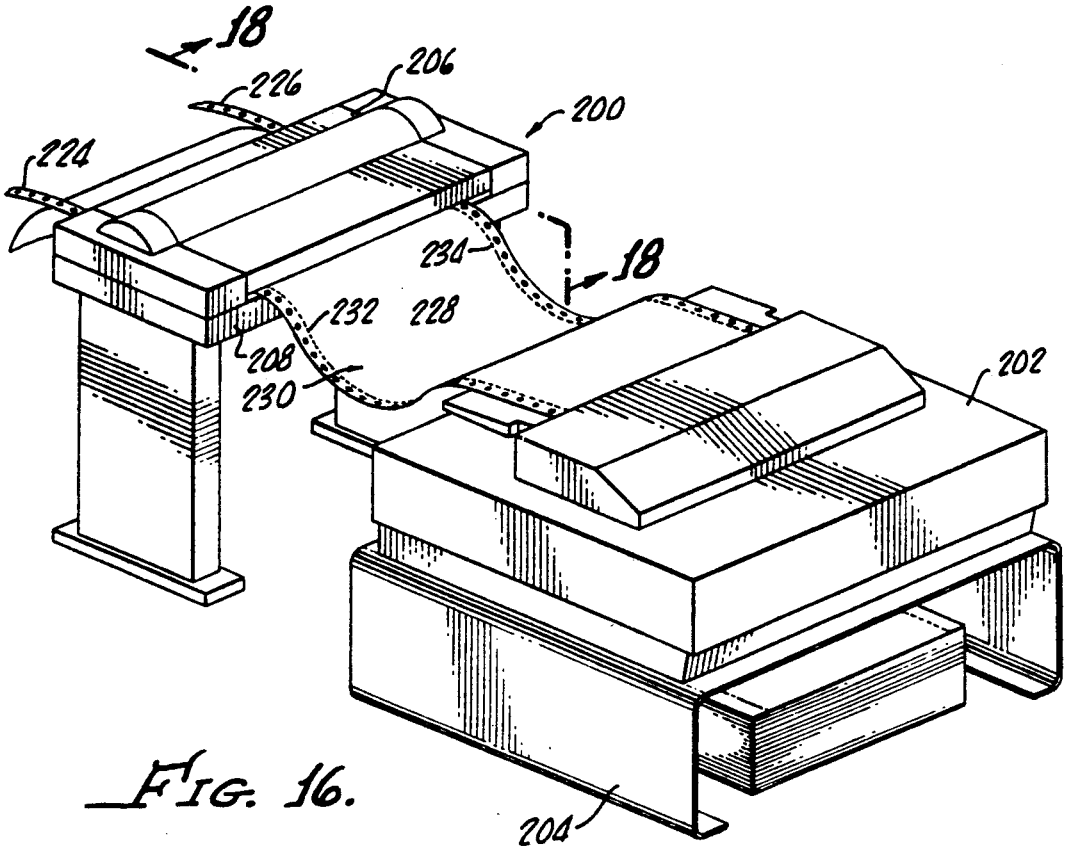
FIG. 16.
FIG. 17.
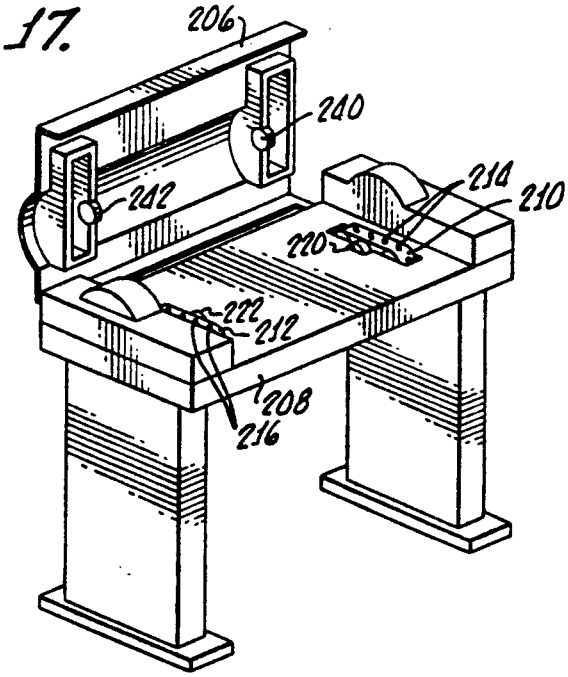

206
242
242
206
214
226
228
220
228
210
214
208

PAPER SEPARATOR

RELATION TO EARLIER FILED APPLICATION

This application is a continuation-in-part application of U.S. Ser. No. 156,207, filed Feb. 16, 1988, now U.S. Pat. No. 4,940,347 and a continuation-in-part of Patent Cooperation Treaty Patent Application Serial No. PCT/US89/00585 designating the United States of America.

The present invention is generally directed to apparatus for separating the marginal edge of a continuous sheet of paper. More particularly, the apparatus of the present invention is directed to apparatus for feeding edge perforated paper and the simultaneous separation of paper-drive edge tear strips from a paper form along the perforations therein.

Most high-speed, computer-operated printers utilize forms which include paper-drive edge tear strips having punched holes therein which are engaged for moving the paper form in a coordinated manner past a printing station, or printhead. In many instances, the paper form consists of a single sheet; however, it is not uncommon for the form to include multiple sheets with a transfer system therebetween for making simultaneous copies. Often printers are used in retail establishments for simultaneously producing sales receipts, store record copies and inventory control documents.

While the high speed printer facilitates the production of documents from continuous, fan-folded, edge-perforated forms, it is necessary to manually separate, or burst, the paper-drive edge tear strips in order to produce presentable single sheet documents. This paper handling must be done by an operator and the time and effort necessary detracts from the convenience and speed of the document production. Not only is the separation of the paper drive edge tear strips inconvenient and time-consuming, but the document is often ripped in the process of attempting to separate, or burst, the paper-drive edge tear strips from the paper form.

Heretofore, a number of attempts have been made to separate the edge tear strips from a body form. A few of these have utilized a knife blade for cutting the edge strips along the perforations between the edge strips and the form of body. An example of this type of separation system is shown in Australian Patent No. 241,251, published on Mar. 17, 1960. While this type of apparatus may successfully separate the edge strips from the form body, the cutting blade is prone to dulling and hence requires continual replacement. In addition, because of the dulling nature of the blade, consistent clean separation of edge strips does not occur. Careful attendance must be made to the blade, particularly with high speed, high volume printers, because many feet of paper can be passed through the printer without proper edge separation. Obviously, when this occurs, the blade must be replaced and the unseparated strips thereafter manually removed. Unfortunately, a partial removal of the strip may also cause fouling in the subsequent handling and stacking of the paper.

A number of devices have been made which utilize deviant paths to separate the paper form body from the edge strips. Examples of these are U.S. Pat. Nos. 2,188,347 to Fulk; 2,308,551 to Sherman; 2,317,384 to Johnson; 4,096,981 to Martorano; 4,423,975 to Krenz; and 4,616,773 to Kerivan.

It should be noted that all of these devices have been directed to the separation of edge strips from a paper body simultaneous with printing on the paper. Heretofore, no one has attempted to develop a hand-held device for separating the paper edges subsequent to printing thereof. It is also significant to note that while the problem of separating the edge strips has been well known for at least fifty years, as evidenced by the hereinabove referenced U.S. Patents, there is no successful device or apparatus presently on the market for separating the edge strips from paper body forms, whether the device is hand-held or incorporated into a printer.

It is apparent that in view of the recent popularity of home computers and printers therefor using continuous forms, there would be great marketing advantage for a printer manufacturer to incorporate an edge separator in their machines. To date, no such manufacturer has done so and one must conclude that all of the devices heretofore produced, including those shown in the hereinabove cited references, cannot be successfully implemented. One reason for this lack of commercial success is that the devices must be able to effectively separate the edge strips, while not inconveniencing the handling of the paper or causing a malfunction in the feeding of the paper through the printer.

Many of the devices disclosed in the hereinabove cited patents substantially increase the difficulty in loading the paper into the cutting device. Some of the devices, as for example, that shown in U.S. Pat. No. 4,616,773, involve complicated flexural members which operate in an oscillating fashion, to alternatively store energy taken from the moving paper and thereafter utilize the energy to burst the side perforations. All this is done in order that the shearing load does not add to the starting load on the motor. It would appear that while this device may be operable in a short term, one skilled in the art would expect that its long term dependability would be suspect because of the required movement of the flexible members to burst the perforations.

The present invention provides for a simple apparatus which may be hand-held, incorporated or used with a printing machine for efficiently separating the edge tear strips from a paper body without the use of oscillating or vibrating parts or knife blades. The simplicity of the device overcomes all of the drawbacks from the heretofore devices and provides a clean separation of edge tear strips from paper forms, which is trouble-free and reliable.

SUMMARY OF THE INVENTION

A paper transfer feed separator in accordance with the present invention for automatically separating paper-drive edge tear strips from a paper form along perforations therein generally includes a frame and a frame shoulder which provides means for guiding an edge tear strip in order to enable a body portion of a paper form to be urged out of the plane of the edge tear strip along perforations to separate the body portion from the edge tear strip. Also provided are a lid and a lid shoulder which provides means for urging the body portion out of the plane of the edge tear strip.

More particularly, a belt may be provided for moving drive pins along the frame, with the drive pins being sized to engage punched holes in the edge tear strips. In addition, drive means may be provided for moving the belt and the drive pins.

Frame shoulder means are provided for guiding the edge tear strips and for enabling a body portion of the paper form to be urged out of the plane of the edge tear strip along the perforations in order to separate the body portion from the edge tear strips. In conjunction therewith, lid means are provided for keeping the drive pins engaged with the punched holes with the lid means including lid shoulder means for urging the body portion out of the plane of the edge tear strip to separate the body portion from the edge tear strip in cooperation with the frame shoulder means. Dependability of the operation of the present invention is assured by the incorporation of the paper separation function in the frame itself via the frame shoulder and the lid shoulder means. No additional complicated apparatus or knife blades need be utilized to effect the separation of the edge strips from the paper form.

In one embodiment of the present invention, handle means are provided for providing the paper tractor feed apparatus to be hand-held, while separating the paper drive edge tear strip from a paper form. While this may be done in an improved automatic manual fashion, electric motor means, coupled with the drive means, may be provided for moving the belt and drive pins. In this manner, the paper edge strip may be engaged with the drive pins and thereafter the paper moved through the separator by the electric motor. This is to be contrasted with the non-motorized embodiment of the present invention in which the paper is manually pulled through the separator.

More particularly, in accordance with the present invention, the lid shoulder means includes a depending portion and the frame shoulder means comprises a corresponding depressed portion, with the depending portion and the depressed portion being spaced apart to enable the passage of the body portion of the paper form along the perforations to pass therethrough. In order to enable passage of paper through the separator with less frictional resistance, the depending portion of the lid shoulder means may include roller means for urging the body portion of the paper into the depressed portion of the frame shoulder means. In this embodiment, the paper tractor feed apparatus is effective in causing the simultaneous separation of multi-sheets, as for example, up to 16.

To facilitate loading of the edge paper strip into the paper tractor feed separator, in accordance with the present invention, hinge means may be provided for enabling the lid means to be moved to an open position, which enables the edge tear strip punched holes to be engaged with the drive pins without movement of the drive belt or drive pins, and to a closed position for keeping the drive pins engaged with the punched holes. Spring means may be provided for holding the lid means in either the open or the closed position and for moving the lid portion to the closed position with sufficient force to initiate separation of the edge tear strips.

Alternatively, spring means may be provided for holding the lid means in the open position when hand pressure is removed therefrom. This embodiment enables hand pressure to close the lid and to exert sufficient force to cause the lid and shoulder means to urge the body portion out of the plane of the edge tear strip to cause separation therebetween.

In another embodiment of the present invention, in combination with a printer, paper transfer feed apparatus includes a pair of tractor feed separators for automatically moving a continuous feed paper form past a printing station in the printer and for automatically separating the paper drive edge tear strips from each side of the continuous feed paper form along the perforations therein. Each of the tractor feed separators are mirror images of one another, with each tractor feed apparatus including a frame, a belt for moving drive pins along the frame, and drive means for moving the belt and the drive pins. Each paper transfer feed apparatus includes frame and shoulder means for guiding the edge tear strip and enabling a body portion of the paper form to be urged out of the plane of the edge tear strip along the perforations in order to separate the body portion from the edge tear strip and lid means for keeping the drive pins engaged with the punched holes in the tear strip and including lid and shoulder pins for urging the body portion out of the plane of the edge tear strip in cooperation with the frame shoulder means to separate the body portion from the edge tear strip.

Mounting means are provided for supporting each said tractor separator in a spaced apart relationship with one another for engaging the continuous feed paper form past the printing station and power take-off means are included for providing power to the drive means of each tractor separator and coordinating movement of the paper with the operation of the printing station.

BRIEF DESCRIPTION OF THE DRAWINGS

A better understanding of the present invention may be had with the consideration of the following detailed description, taken in conjunction with the accompanying drawings in which:

FIG. 7 is a perspective view of an alternate embodiment of a paper tractor feed separator in accordance with the present invention shown in an operational relationship with a multiple sheet paper form for separating multiple paper-drive edge tear strips therefrom;

FIG. 8 is a perspective view of the embodiment shown in FIG. 7 showing an open lid and a belt with drive pins for engaging holes in the paper-drive edge tear strips;

FIG. 14 is an alternative embodiment of the present invention in which a printer stand is provided with the paper tractor feed separator being activated by a paper sensor;

FIG. 15 is a cross-sectional view of the embodiment shown in FIG. 14, taken along the line 15—15 of FIG. 14;

FIGS. 16–17 are views of yet another embodiment of the present invention in which the paper tractor feed separator may be incorporated into a self-standing printer accessory.

DETAILED DESCRIPTION OF THE INVENTION

Figure 1:
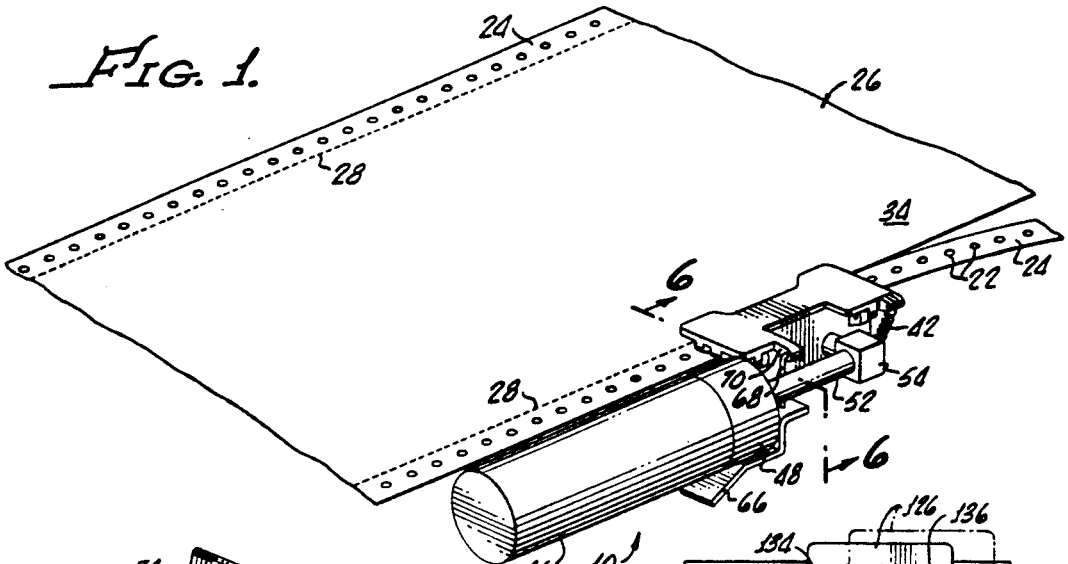
FIG. 1 is a perspective view of a paper tractor feed separator in accordance with the present invention shown in an operational relationship with a paper form for separating paper-drive edge tear strips therefrom.
Figure 2:
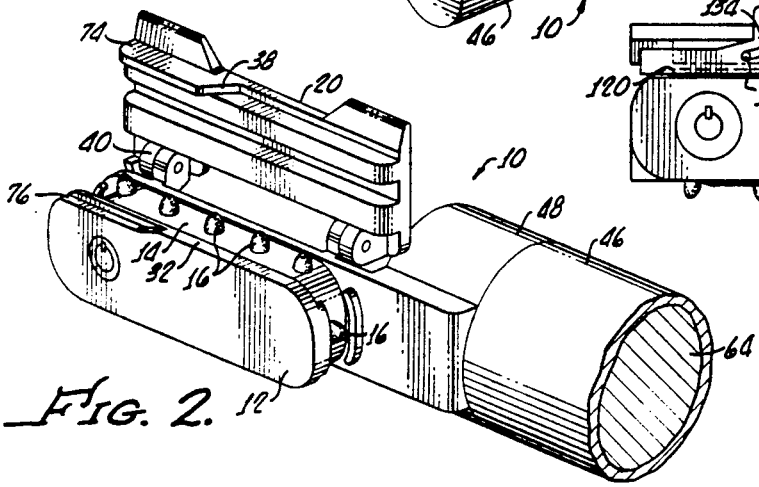
FIG. 2 is an enlarged perspective view of the paper tractor feed separator showing a lid opened for access to a belt for moving drive pins along a frame of the paper tractor feed separator and both a frame shoulder and lid shoulder for causing the separation of the body portion of the paper form from the edge of tear strip.

Turning now to FIGS. 1 and 2, there is shown a paper tractor feed separator 10, in accordance with the present invention which generally includes a frame 12, a belt 14, for moving drive pins 16 along the frame 12 and a lid 20 which provides means for keeping the drive pins 16 engaged with punched holes 22 in paper-drive edge tear strips 24 which are attached to a paper form 26 along perforations 28 therein.

Specifically, the frame 12, belt 14, drive pin 16, and lid 20 may be formed of any conventional material well known in the art with the drive pins 16 being sized and spaced apart in a conventional manner for engaging the punched holes 22 in the strip 24.

A frame shoulder 32 provides means for guiding the edge tear strip 24 to enable a body portion 34 to be urged out of the plane of the edge tear strip 24 along the perforations 28 in order to separate the body portion 34 from the edge tear strip 24 as shown in FIG. 1. In cooperation therewith, the lid 20 includes a lid shoulder 38 which provides means for urging the body portion 34 out of the plane of the edge tear strip 24 to separate the body portion 34 from the edge tear strip 24 as illustrated in FIG. 1. This simple arrangement requires no additional mechanisms such as springs or knife blades in order to effectively separate the edge tear strips 24 from the body 34 of the paper form 26. Because no moving parts are utilized, the apparatus is both efficient and reliable and is inexpensive to fabricate compared with prior art devices. The lid 20 may be hinge 40 mounted to the frame 12 and may be held in an open position such as shown in FIG. 2 by a spring 42, see FIG. 1, interconnected between the lid 20 and the frame 12 in a conventional manner.

In the hand-held embodiment shown in FIGS. 1–6, a handle 46 may be provided for enabling the paper tractor feed separator 10 to be manually grasped while separating the paper form 26 into the paper-drive edge tear strip 24 and body portion 34. In addition, the handle 46, which may be formed of plastic or the like, may house or be attached to an electric motor 48 which is interconnected to a drive sprocket 50 by means of a drive shaft 52 and gear box 54 in a conventional manner for moving the belt 14 and the drive pins 16. As most clearly shown in FIG. 3, the drive sprocket 50 includes cutaway portions 58 for engaging the underside 60 of the drive pins 16 in order to move them along the frame 12 and over a center guide member 62 in a conventional manner. Batteries, not separately shown, may be housed inside the handle 46 for powering the motor 48 and a switch lever 66 may be provided for turning the motor 48 on to move the drive pins 16 for operating the paper tractor feed separator 10.

It should be appreciated that it is not necessary to power drive the belt 14 in order to operate the paper tractor feed separator 10. If no motor is provided or the batteries are dead, manual movement of the separator 10 relative to the paper form 26 causes efficient separation of the edge tear strip 24 from the body 34.

The switch lever 66 may be coupled to the lid 20 by way of a link 68 attached to a lid arm 70 so that when the switch lever 66 is depressed, the lid 20 is pivoted about the hinges 40 into a closed position moments before the power is applied to the drive sprocket 50 for moving the edge strip 24 and causing separation thereof from the paper body 34.

Figure 3:
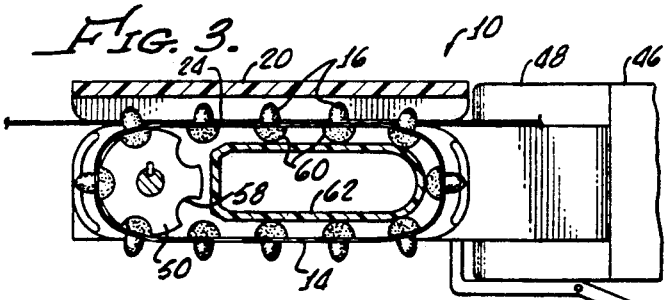
FIG. 3 is a cross-sectional view of eh belt and drive pins.
Figure 5:
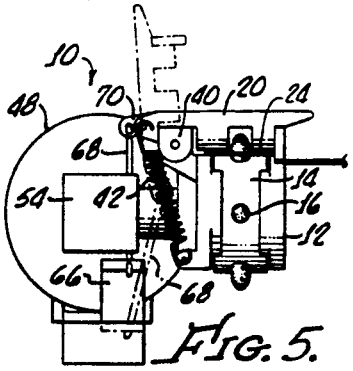
FIG. 5 is a view of the paper tractor feed separator showing a spring for holding the lid in an open position.
Figure 4:
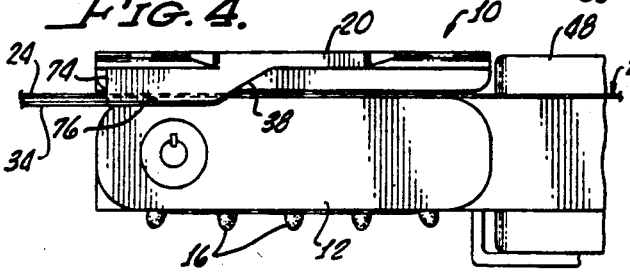
FIG. 4 is a side view of the paper tractor feed separator with the lid closed in which a depending portion of the lid shoulder and depressed portion of the frame shoulder cooperate to provide a means for urging the body portion of the paper form out of the plane of the edge tear strip to separate the body portion from the edge tear strip.
Figure 6:
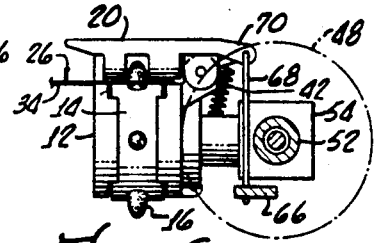
FIG. 6, a cross-section, taken along the line 6—6 of FIG. 1, shows the lid interconnected to a power switch by a link in order that the lid may be closed and the motor turned on by the switch.

In operation, the hinges 40 provide a means for enabling the lid 20 to be moved to an open position, as shown in FIG. 2, to enable the edge tear strip punched holes 22 to be engaged with the drive pins 16 without movement of the drive belt 14, or pins 16. After the edge strip punched holes 22 are placed in an engagement relationship with the drive pins 16, as shown in FIGS. 1, 3 and 4, force on the switch lever 66 maintains the lid 20 in a closed position for keeping the drive pins 16 engaged with the punched holes 22. When the switch lever 66 is depressed further to start the motor 48, the drive sprocket 50 is turned, moving the pins 16 with the edge tear strip 24 and body motion 34 attached thereto.

The lid shoulder 38 includes a depending portion 74 and the frame shoulder 32 includes a depressed portion 76 with the depending portion 74 and the depressed portion 76 being spaced apart, when the lid 20 is closed, to enable passage of the body portion 34 of the paper form 26 to pass therethrough.

As this movement occurs, the depending portion 74 pushes the body portion 34 into the depressed portion 76, as shown in FIG. 4, thus urging the body portion 34 out of the plane of the edge tear strip 24 along the perforations 28 to separate the body portion 34 from the edge tear strip 24, as the edge tear strip 24 and body portion 34 are moved through the paper tractor feed separator 10.

Turning now to FIG. 7 and 8, there is shown another paper tractor feed separator 11, in accordance with the present invention, which generally includes a frame 13, a belt 15 for moving drive pins 17 along the frame 13 in a coordinated manner and a lid 21 which provides means for keeping the drive pins 17 engaged with punched holes 23 in paper drive edge strips 25 which are attached to a paper form 27 along perforations 29 therein.

As more clearly shown in FIG. 7, the tractor feed separator 11 is particularly suitable for the separation of multiple edge tear strips 25*a*, 25*b*, 25*c*, 25*d* from a folded paper form 27 in a simultaneous fashion. The separator 11 is suitable for separating multiple forms, for example, up to 16 or 20 depending upon the thickness of the individual sheets 27*a*, 27*b*, 27*c*, 27*d*, in the paper form 27. Heretofore, separation of a stack of forms 27 was accomplished by bending the stack along the perforations 29 and manually pulling the edge tear strips 25*a*, 25*b*, 25*c*, 25*d* away from the body 35 of the paper. This, however, left ragged edges which must thereafter be manually plucked from the body 35 in order to achieve a clean separation of the edge strip 25 therefrom.

It should be appreciated that, while only four sheets 27*a*, 27*b*, 27*c*, 27*d* are shown, a larger number of sheets (not shown) may be simultaneously separated depending upon the sheet thickness. While the separator 11 has been utilized to separate up to 20 individual sheets, more may be possible depending upon the thickness of the form 27 and the size and type of perforations 29.

As shown in FIG. 7 and 8, the paper tractor feed separator 11 is purely a manual device not incorporating the handle 46 and motor 48 of the embodiment 10 shown in FIGS. 1–6. The present embodiment 11 is designed so that the frame 13 and lid 11 provide means for enabling the paper tractor feed separator 11 to be hand 37 held while separating the paper drive edge tear strip 25 from the paper form 27.

As more clearly shown in FIG. 8, a frame shoulder 33 provides means for guiding the edge tear strip 25 to enable the body portion 35 to be urged out of the plane of the edge tear strip 25 along the perforations 29 in order to separate the body portion 35 from the edge tear strip 25 as shown in FIG. 7. In cooperation therewith, the lid 21 includes a lid shoulder 39 with a roller 41 for providing means for urging the body portion 35 out of the plane of the edge tear strip 25 to separate the body portion 35 from the edge tear strip 25 as illustrated in FIG. 7.

Cooperating with the lid shoulder 39 is a depressed portion 43 of the frame shoulder 33 along with a roller 45 for reducing friction as the multiple sheet form 27 is moved relative to the separator 11.

In operation, the embodiment 11 operates in a manner similar to the embodiment 10 shown in FIGS. 1–6, except that the tractor feed separator 11 and form 27 are moved relative to one another, as shown by the arrows 47, 49.

The lid 21 of the tractor feed separator 11 may be hinge 51, 53 mounted to the frame 13 and a spring 55 may be provided and coupled therebetween for holding the lid 21 in an open position as shown in FIG. 8. In operation, the lid 21 is closed toward the frame shoulder 33 as shown in FIG. 7 by finger 57 pressure and thereafter pulled along the paper form 27 or alternatively, or simultaneously, the form 27 is moved in a direction 49 relative to the separator 11.

It should be appreciated that the separator 11 is similar in all respects with regard to the construction of the separator 10 shown in FIGS. 3–6, except that no motor (not shown) or additional handle (not shown) is utilized.

Figure 9:
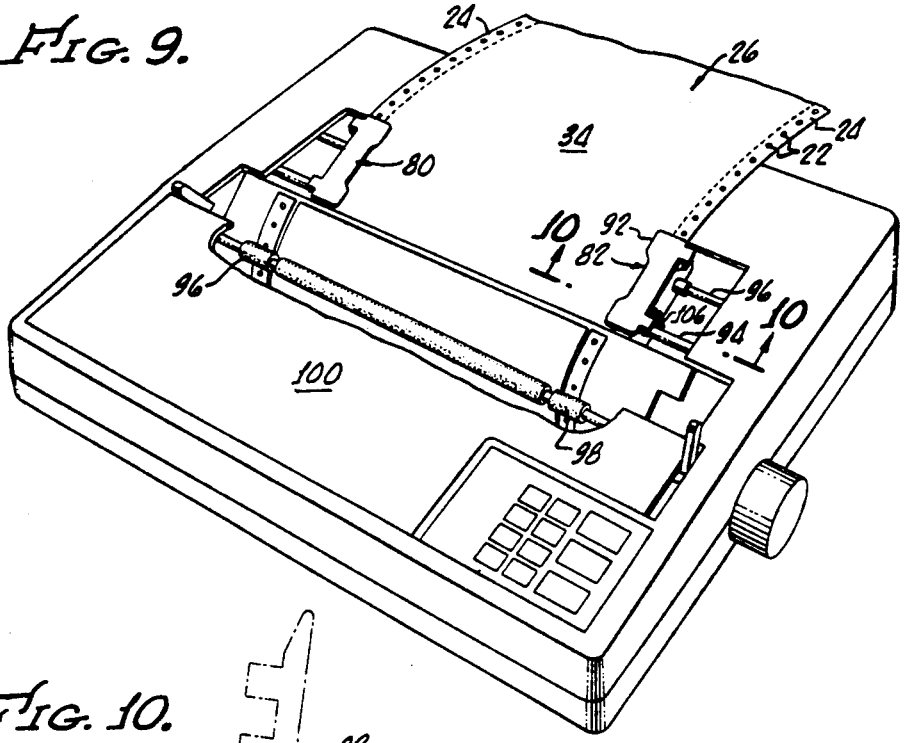
FIG. 9 is a perspective view of another embodiment of the present invention as it may be installed on a printing device.
Figure 10:
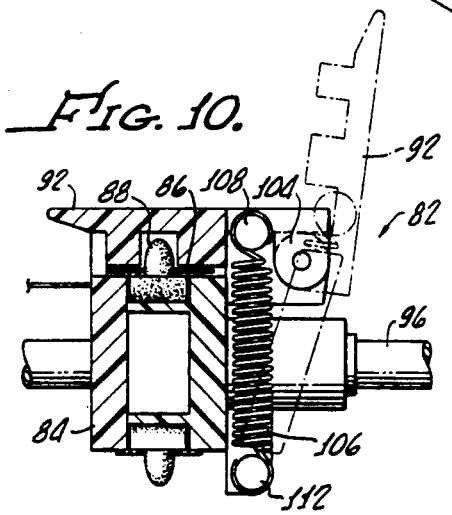
FIG. 10, is a cross-sectional view of the alternative embodiment of the present invention taken along the line 10—10 in FIG. 9, showing a lid that is held in open position and in a closed position by a single spring.
Figure 11:
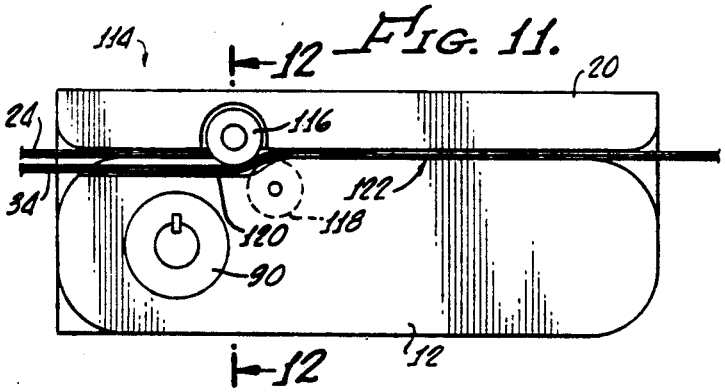
FIG. 11 is a side view of alternative embodiment of the present invention utilizing a roller for urging the body portion of the paper form into the depressed portion of the frame shoulder.

Turning now to FIG. 9, there is shown an alternative embodiment of the present invention which includes a pair of tractor feed separators 80, 82 disposed in a conventional printer. As shown in FIGS. 10 and 11, each of the separators 80, 82 include a frame 84, a belt 86 for moving drive pins 88 along the frame 84 and a drive sprocket 90 for moving the belt 86 and the drive pins 88. The separators 80, 82 may be disposed on a pair of parallel shafts 94, 95, with the latter being power driven and engaging the sprocket 90 for driving the belt 86 and drive pins 88 for moving the paper form 26 as hereinbefore described in connection with the hand-held paper tractor feed separator 10.

In addition and in combination therewith, a pair of rollers 96, 98 may be provided for separately supporting and guiding the tear strips 24 subsequent to separation from the body 34 as they pass a print station 100 to prevent undesired misdirection of the strips 24 during a print operation. The operation of the separators 80, 82 is identical to the operation of the hand-held paper tractor feed separator 10, as hereinabove described. However, as shown in FIG. 10, the lid 92 is hinge 104 mounted to the frame 84 and may be held in either an open or a closed position by a spring 106 coupled to the lid 92 by means of a pin 108 and aligned with the hinge 104 and a frame pin 112 so that an off-set relationship therebetween enables the spring 106 to hold the lid 92 in either the closed position or the open position, the latter facilitating the initial feeding of the paper form 26 thereinto and the coupling of the paper strip holes 22 with the drive pins 88.

Figure 12:
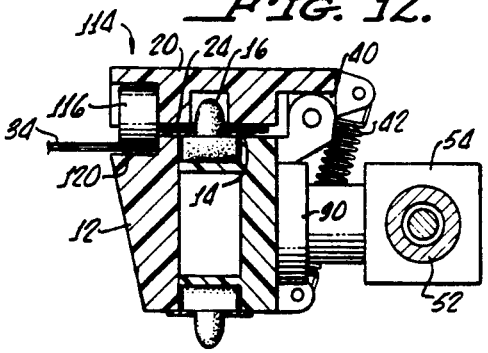
FIG. 12 is a cross-sectional view of the present invention taken along the line 12—12 shown in FIG. 11.

Shown in FIGS. 11 and 12, a tractor feed separator 114, in accordance with the present invention, may alternatively include a frame 12', a lid roller 116 and a frame roller 118, which provide means for urging the body portion 34 of the paper form 26 into a depressed portion 120 of frame shoulder 122. Like reference numerals, or characters, shown in FIGS. 11 and 12 refer to identical or corresponding parts shown in FIGS. 1–6. In operation, the paper path as shown in FIG. 11 enables the lid roller 116 to urge the paper body 34 out of the plane of the edge paper strip 24. It has been found that this arrangement is useful in simultaneously separating forms 26, which include up to 16 sheets.

Figure 13:
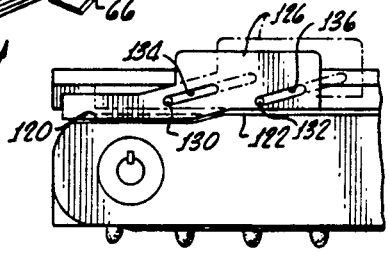
FIG. 13 is a side view of an alternative embodiment of the present invention in which the paper tractor feed separator can be switched from a paper separating mode to a non-separating mode.

In instances where it is desired to utilize the tractor feed separator without separation of the edge strips 24 from the body 34, the present invention may include a lid portion 126 which is slidably mounted by means of pins 130, 132 and slots 134, 136, in order that the depending portion 128 thereon may be slid to a position where it does not urge the paper body 34 out of the plane of the edge strip 24, as is shown in FIG. 13.

It should also be appreciated that when rollers are used for urging the paper body 34 out of the plane of the edge strip 24, various widths of rollers may be utilized in order to accommodate for varying edge paper strip widths.

Turning now to FIGS. 14 and 15, there is shown an alternative embodiment 130 of the present invention which includes a pair of tractor feed separators 132, 134, disposed on a printer base 136 having an inclined pad 138 for supporting a conventional printer 140 over a shelf 142 for supporting paper stack 144. Upright portions 146, 148 having a pair of parallel shafts 150, 152 disposed therebetween support a pair of the tractor feed separator 132, 134 in an operative relationship with paper 154 emerging from the printer 140. Power shaft 150 is driven by a motor 156 (FIG. 15) and gear drive 158 as hereinbefore described. The tractor feed separators 132, 134 are identical to those hereinbefore described.

The tractor feed separators 132, 134 are slidably mounted on the shaft to enable adjustment for various size paper 154.

A wire control bar 160 pivotally mounted to the upright portions 146, 148 and interconnected with a microswitch 162 provides means for controlling the motor 156 and paper movement. When the power switch 164 is turned on and the paper 154 fed beneath the control bar 160 and through the tractor feed separators 132, 134, the tension of the paper 154 between the tractor feed separator 132, 134 and the printer 140 controls the feeding of paper through the tractor feed separators 132, 134. As can be seen when the printer feeds the paper 154 and the motor 156 is not driving the separators 132, 134, gravity will cause the control bar 160 to dip and activate the microswitch 162. Upon stopping of the printer, continual feed of paper through the separators 132, 134 will cause the paper 154 to lift the control bar 160 to turn the motor 156 off.

While one type of control means is shown by way of specific example, it is to be appreciated that any number of other configurations may be used to coordinate the operation of the tractor feed separator 132, 134 and the printer 140.

Figure 18:
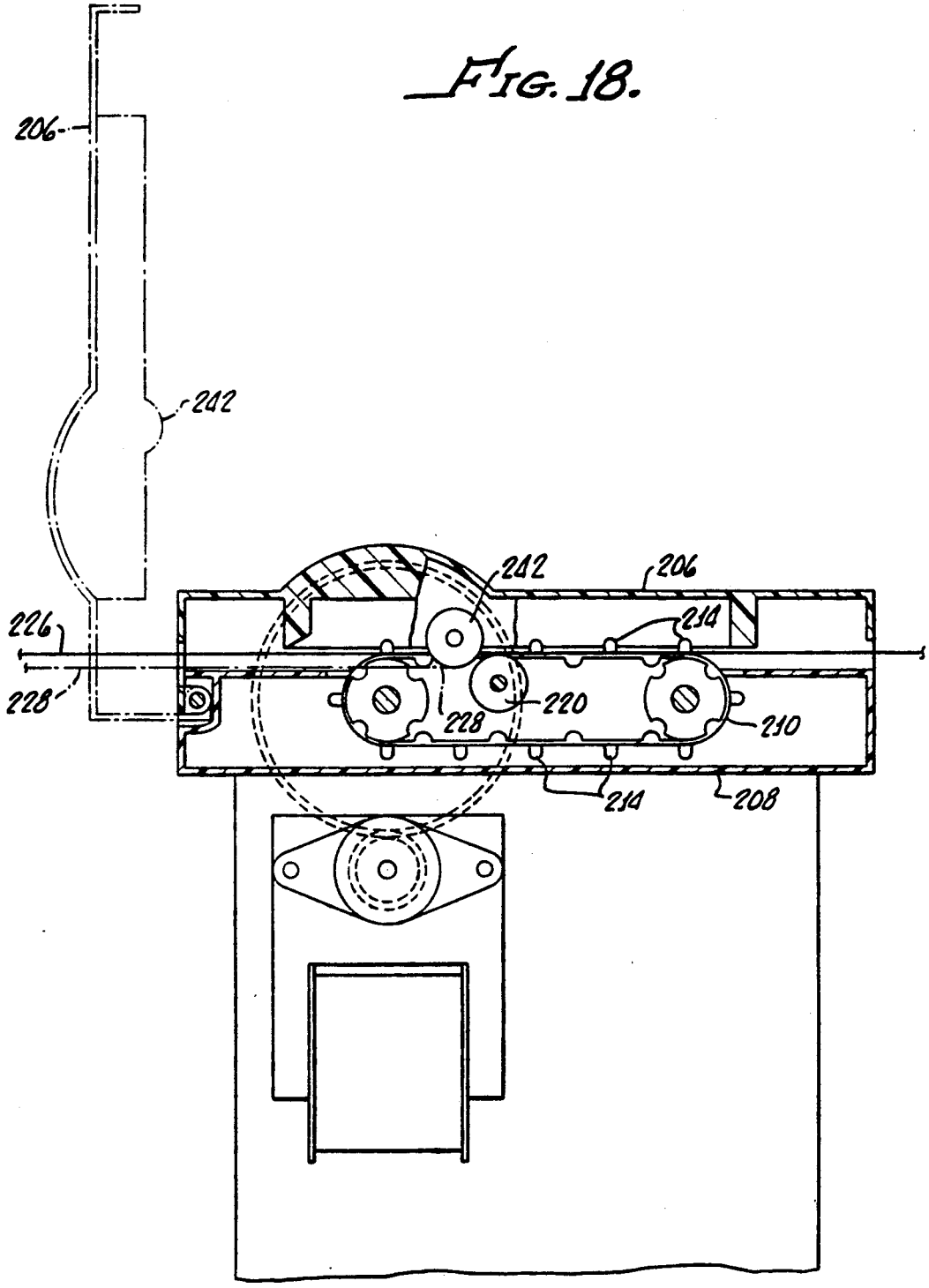
FIG. 18 is a cross-sectional view of the embodiment of FIG. 16 taken along the line 18—18.

Turning now to FIGS. 16–18 there is shown yet another embodiment 200 of the present invention which may be used as a self-standing accessory for a conventional printer 202 and stand 204. This embodiment 200 functions in a manner similar to that hereinabove described in connection with embodiment 130 shown in FIGS. 14 and 15. However, it incorporates a hinged cover 206 disposed on a frame 208, with the latter incorporating belts 210, 212 having drive pins 214, 216 identical to that hereinabove described in connection with the paper tractor feed separator 10 and 130. Frame shoulders 220, 222 provide a means for guiding edge tear strips 224, 226 to enable a body portion 228 of the paper stock 230 out of the plane of the edge tear strips 224, 226 along perforations 232, 234, in order to separate the body portion 228 from the edge tear strips 224, 226. This operation was hereinabove described in connection with the strippers 10 and 130. In the embodiment 200 of FIGS. 16–18, however, lid shoulders 240, 242 are provided in the hinged cover 206 as may be most clearly seen in FIG. 17. In a closed position as shown in FIG. 16, the shoulders 240, 242, provide a means for urging the body portion 228 of the paper stock 230 out of a plane of the edge tear strips 224, 226 as hereinbefore described.

A cross-sectional view of the embodiment 200 is shown in FIG. 18 which is taken along the line 18–18 of FIG. 16 and which shows the separating operation as hereinbefore described.

Although there has been hereinabove described specific arrangements of paper tractor feed separator apparatus, in accordance with the invention, for the purpose of illustrating the manner in which the invention may be used to advantage, it will be appreciated that the invention is not limited thereto. Accordingly, any and all modifications, variations, or equivalent arrangements which may occur to those skilled in the art should be considered to be within the scope of the invention as defined in the appended claims.

What is claimed is:

1. A paper tractor feed separator for automatically separating paper-drive edge tear strips from a paper form along perforations therein, said paper tractor feed separator comprising:

a frame;

frame shoulder means for guiding said edge tear strip to enable a body portion of the paper form to be urged out of the plane of the edge tear strip along the perforations in order to separate the body portion from the edge tear strip; and a lid, said lid including lid shoulder means for urging the body portion out of the plane of the edge tear strip to separate the body portion from the edge tear strip.

2. The paper tractor feed separator in accordance with claim 1 further comprising handle means for enabling the paper tractor feed separator to be hand-held while separating the paper-drive edge tear strip from a paper form.

3. The paper tractor feed separator in accordance with claim 2 further comprising drive means, including an electric motor for engaging the paper form and moving the paper form past the frame shoulder means and lid shoulder means.

4. The paper tractor feed separator in accordance with claim 1 wherein the lid shoulder means comprises a depending portion and the frame shoulder means comprises a corresponding depressed portion, said depending portion and depressed portion being spaced apart to enable passage of the body portion of the paper form along the perforation, to pass therethrough.

5. The paper tractor feed separator in accordance with claim 4 wherein the depending portion of the lid shoulder means comprises roller means for urging the body portion of the paper form into the depressed portion of the frame shoulder means.

6. The paper tractor feed separator according to claim 4 further comprising hinge means for enabling the lid means to be moved from an open position to enable placement of the paper form between the frame shoulder means and the lid shoulder means to a closed position for separating the paper-drive edge tear strip from the paper form.

7. The paper tractor feed separator according to claim 6 further comprising spring means for holding the lid means in either the open or the closed position and for moving the lid portion to the closed position with sufficient force to initiate separation of the edge tear strips from the paper form by urging the lid shoulder means depending portion toward the frame shoulder means depressed portion.

8. The paper tractor feed separator according to claim 6 further comprising spring means for holding the lid means in the open position when hand-pressure is removed therefrom and for enabling hand pressure to close the lid and exert sufficient force to cause the lid shoulder means to urge the body portion out of the plane of the edge tear strip to cause separation therebetween.

9. In combination with a printer for printing on a continuous feed paper form, paper tractor feed apparatus comprising:

a pair of tractor feed separators for automatically moving a continuous feed paper from past a printing station in said printer and for automatically separating paper-drive edge tear strips from each side of the continuous feed paper form along perforations therein, each tractor feed separator being a mirror image of the other, each tractor feed separator comprising:

a) a frame;

b) frame shoulder means for guiding said edge tear strip to enable a body portion of the paper form to be urged out of the plane of the edge tear strip along the perforations in order to separate the body portion from the edge tear strip; and c) a lid, said lid including lid shoulder means for urging the body portion out of the plane of the edge tear strip to separate the body portion from the edge strip; and mounting means for supporting each said tractor separator in a spaced apart relationship with one another for engaging the continuous feed paper from edge tear strips.

10. The paper tractor feed apparatus in accordance with claim 9 wherein the lid shoulder means of each tractor feed comprises a depending portion and the frame shoulder means comprises a corresponding depressed portion, said depending portion and depressed portion being spaced apart to enable passage of the body portion of the paper form along the perforation, to pass therethrough.

11. The paper tractor feed apparatus in accordance with claim 10 wherein the depending portion of the lid shoulder means of each tractor feed separator comprises roller means for urging the body portion of the paper form into the depressed portion of the frame shoulder means.

12. The paper tractor feed apparatus according to claim 10 wherein each tractor feed separator further comprises hinge means for enabling the lid means to be moved from an open position enabling placement of the paper form between the frame shoulder means and the lid shoulder means to a closed position separating the paper-drive edge tear strips from the paper form.

13. The paper tractor feed apparatus according to claim 12 wherein each tractor feed separator further comprises spring means for holding the lid means in either the open or the closed position and for moving the lid to the closed position with sufficient force to initiate separation of the edge tear strips from the paper form by urging the lid shoulder means depending portion toward the frame shoulder means depressed portion.

14. The paper tractor feed apparatus in accordance with claim 10 wherein each tractor feed separator further comprises means for moving the lid shoulder means depending portion from a position where the lid shoulder means urges the body portion of the continuous paper form out of the plane of the edge tear strips, to a position where the lid shoulder means does not contact the body portion, the latter position enabling movement of the continuous feed paper form past the printing station without separation of the edge tear strips therefrom.

15. The paper tractor feed apparatus in accordance with claim 14 wherein the mounting means is disposed upstream from the printing station for feeding the continuous feed paper form to the printing station for printing thereon.

16. The paper tractor feed apparatus in accordance with claim 15 further comprising guide roller means disposed at said printing station, for separately guiding each said edge tear strips past the printing station.

* * * * *